US006257298B1

(12) United States Patent
Huang

(10) Patent No.: US 6,257,298 B1
(45) Date of Patent: Jul. 10, 2001

(54) QUIET TAPE DISPENSER

(76) Inventor: Harrison Huang, No. 23, Lin T'So Rd., Shengkang, Taichung Hsien (TW)

( * ) Notice: Subject to any disclaimer, the term of this patent is extended or adjusted under 35 U.S.C. 154(b) by 0 days.

(21) Appl. No.: 09/324,907

(22) Filed: Jun. 3, 1999

(51) Int. Cl.[7] ..... B32B 31/00
(52) U.S. Cl. ..... 156/577; 156/579; 242/588.2
(58) Field of Search ..... 156/574, 577, 156/579, 523, 527; 242/588, 588.2

(56) References Cited

U.S. PATENT DOCUMENTS 4,561,926 * 12/1985 Hamisch, Jr. et al. ..... 156/381
5,164,038 * 11/1992 Sundqvist ..... 156/577
5,549,255 * 8/1996 Huang ..... 242/422.5
5,641,377 * 6/1997 Chung et al. ..... 156/577
5,725,726 * 3/1998 Yu ..... 156/577
5,906,705 * 5/1999 Chung et al. ..... 156/579

* cited by examiner

*Primary Examiner*—Mark A. Osele
(74) *Attorney, Agent, or Firm*—Browdy and Neimark

(57) ABSTRACT

An adhesive tape dispenser comprises a handle, a base fastened with the handle, a tape-cutting device mounted on the base, a shaft disposed in the proximity of one end of an arcuate hole of the base, a sleeve rotatably fitted over the shaft, and a rotary rod disposed in the arcuate hole such that the rotary rod is capable of displacement along the arcuate hole so as to cause the tape roll to be held between the shaft and the rotary rod. The tape is dispensed quietly in such a manner that the tape is gradually unrolled from the tape roll along the rotary rod.

3 Claims, 5 Drawing Sheets

QUIET TAPE DISPENSER

FIELD OF THE INVENTION

The present invention relates generally to an adhesive tape dispenser, and more particularly to a quiet tape dispenser.

BACKGROUND OF THE INVENTION

As shown in FIG. 1, a tape dispenser 10 of the prior art comprises a handle 11, a base 12 located over one side of the handle 11, a cutting device 13 mounted on the front side of the base 12, and a tape mount 14 disposed in the rear side of the base 12. In operation, a tape roll 15 is mounted on the tape mount 14 such that one end of the tape roll 15 is pulled out to put through a roller 131 which is located under the cutting device 13. The cutting device 13 has a cutting tool 132 for severing the tape. The prior art tape dispenser 10 described above is rather noisy while in operation. Such noise is often a source of annoyance in a workplace.

Now referring to FIG. 2, another prior art tape dispenser is basically similar in construction to the tape dispenser 10 shown in FIG. 1 and is patented (U.S. Pat. No. 5,549,255) by this inventor of the present invention. The second prior art tape dispenser is provided with a silencer 20, which has a rotary shaft 23 capable of pressing the surface of the tape so as to enable the tape to be dispensed quietly. However, this second prior art tape dispenser is not good enough according to the opinion of this inventor of the present invention.

SUMMARY OF THE INVENTION

It is therefore the primary objective of the present invention to provide a tape dispenser which is quiet while in operation.

It is another objective of the present invention to provide a tape dispenser which is simple in construction.

In keeping with the principle of the present invention, the foregoing objectives of the present invention are attained by a tape dispenser, which comprises a handle, a base fastened with one side of an upper end of the handle, a cutting device fastened with the front end of the base, a shaft disposed in the proximity of the top end of an arcuate hole of the base, a sleeve fitted rotatably over the shaft, and a rotary rod disposed in the arcuate hole such that the rotary rod is capable of the arcuate displacement in the arcuate hole so as to cause the tape roll to be held between the shaft and the rotary rod. In operation, the tape is dispensed quietly in such a manner that the tape is gradually unrolled from the taper roll along the rotary rod.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
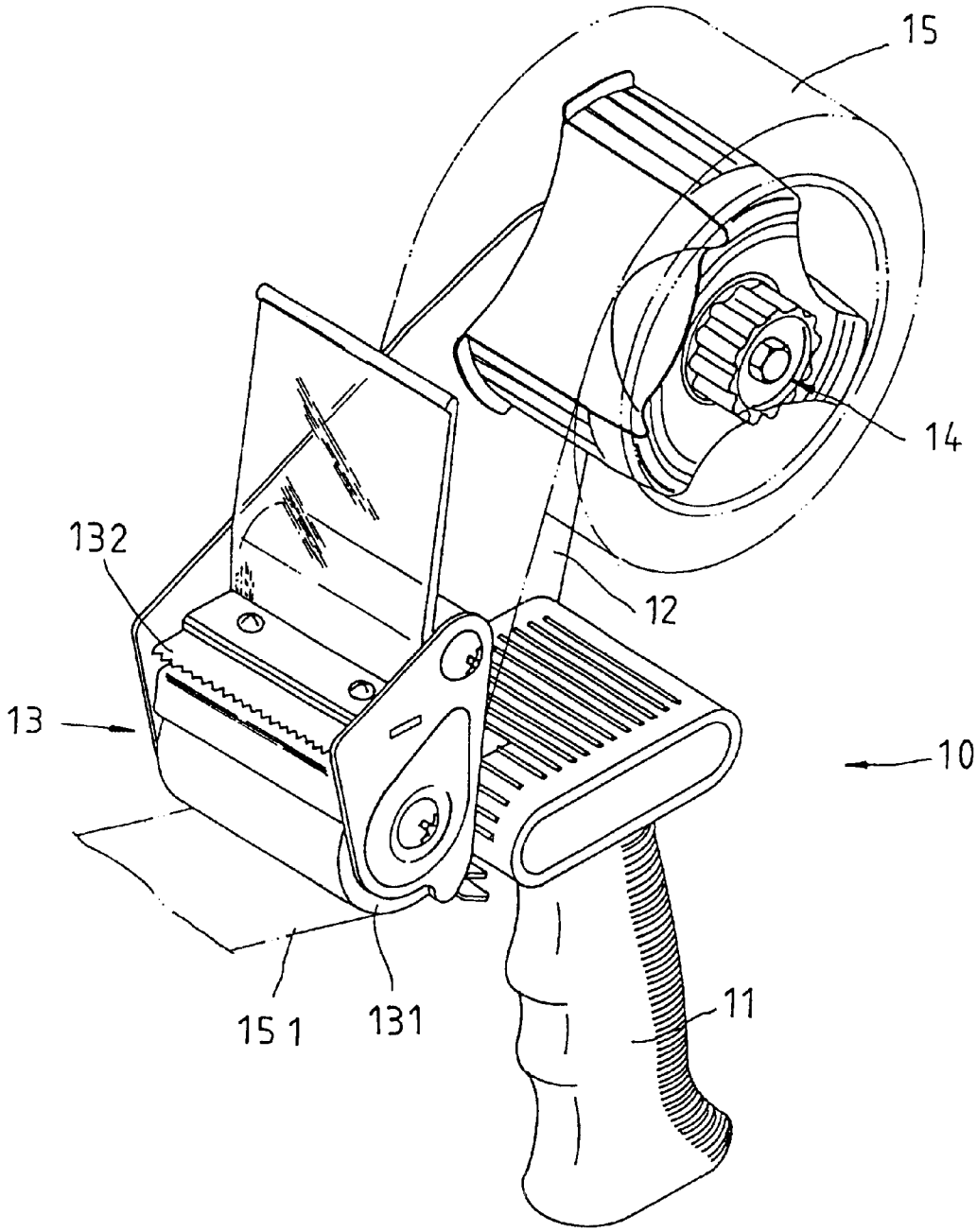
FIG.1 (PRIOR ART)
FIG. 1 shows a perspective view of an adhesive tape dispenser of the prior art.
Figure 2:
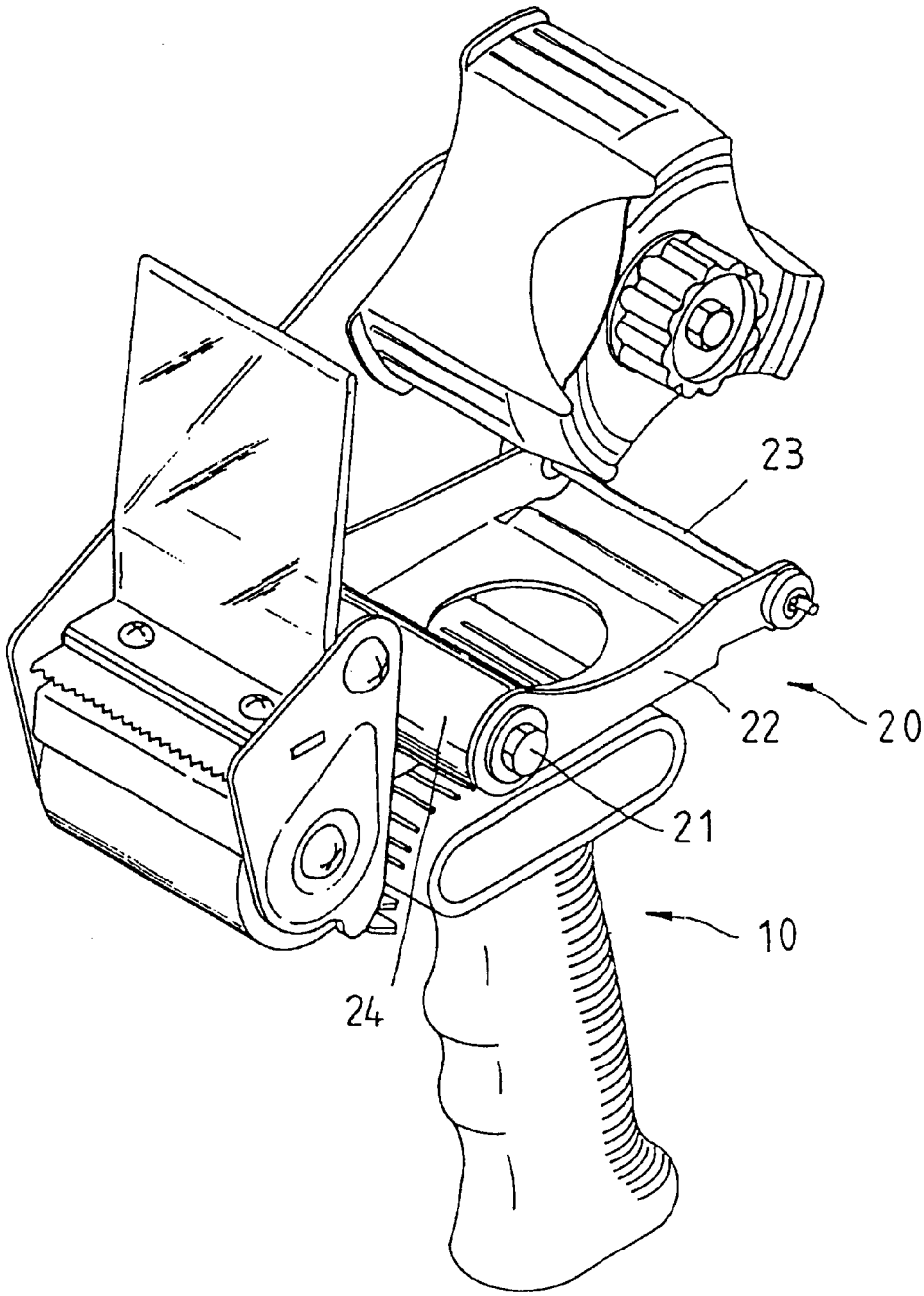
FIG. 2 (PRIOR ART)
FIG. 2 shows a perspective view of another prior art tape dispenser.
Figure 3:
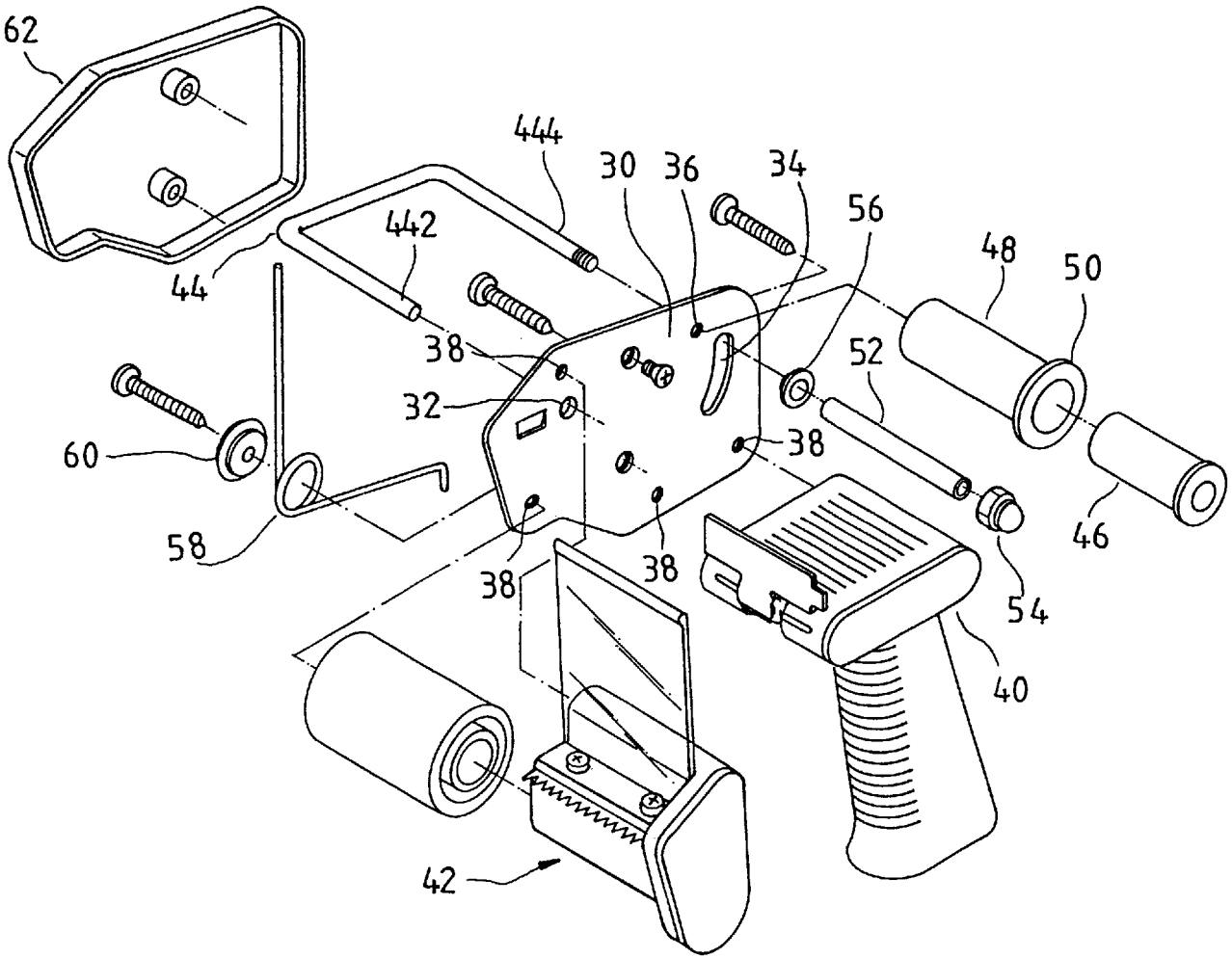
FIG. 3 shows an exploded view of the preferred embodiment of the present invention.
Figure 4:
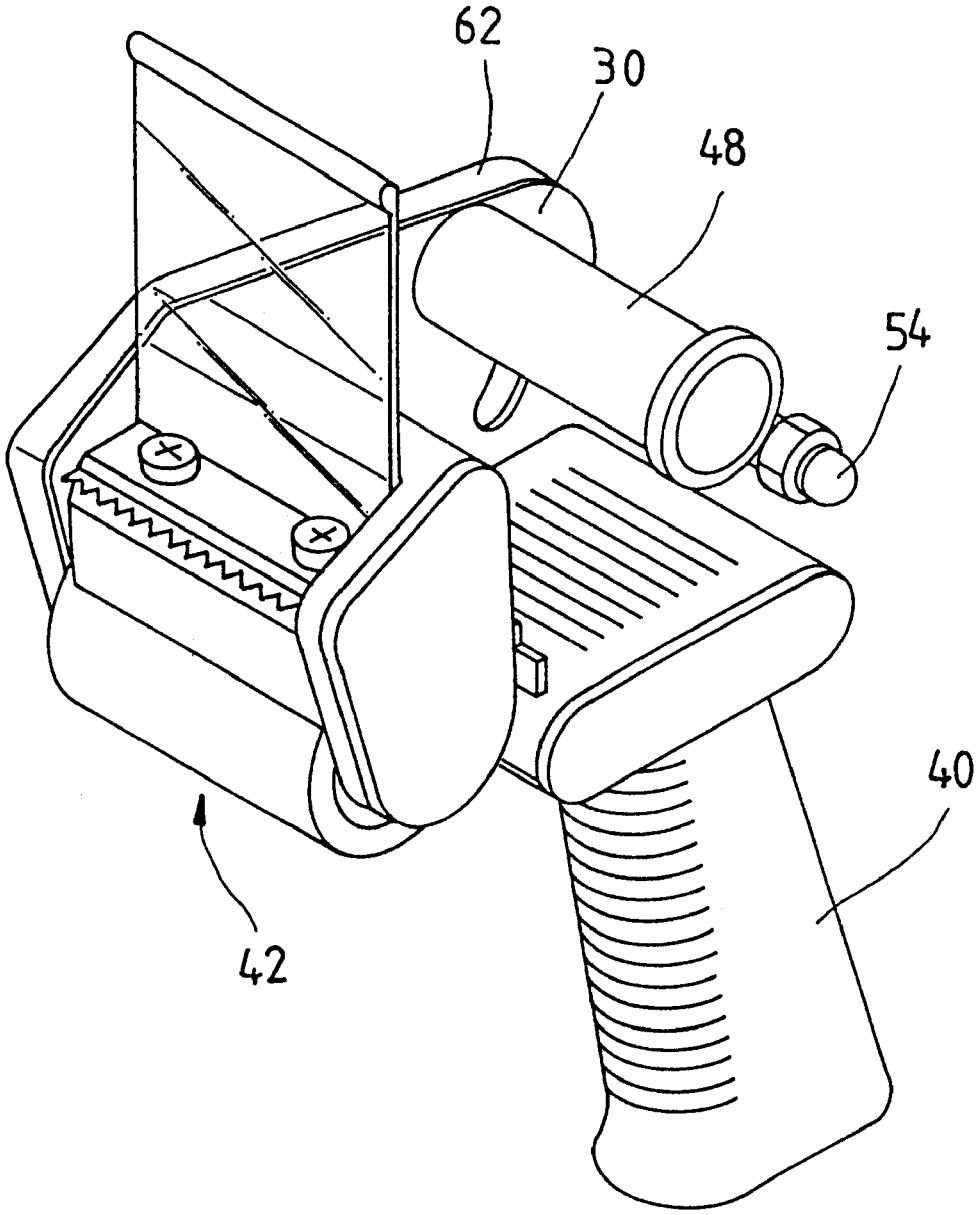
FIG. 4 shows a perspective view of the preferred embodiment of the present invention.

As shown in FIGS. 3 and 4, an adhesive tape dispenser of the preferred embodiment of the present invention comprises the component parts which are described hereinafter.

A base 30 is provided with an axial hole 32, and an arcuate hole 34 which is located on the circumference of an imaginary circle whose center is the axial hole 32. Located in the proximity of the upper end of the arcuate hole 34 is a through hole 36. The base 30 is provided in the bottom thereof and the front end thereof with four threaded holes 38.

A handle 40 is fastened with the front side of the base 30 by two fastening screws which are engaged with two threaded holes 38 of the bottom of the base 30.

A tape-cutting device 42 is fastened with the base by two fastening screws which are engaged with two threaded holes 38 located in the front end of the base 30.

A U-shaped rod 44 has one end 442 which is received in the axial hole 32 of the base 30, and another end 444 which is received in the arcuate hole 34 of the base 30. The U-shaped rod 44 is capable of turning on the end 442 acting as a turning point, thereby causing another end 444 of the U-shaped rod 44 to displace in the arcuate hole 34.

A shaft 46 is fastened at one end thereof with the through hole 36 of the base 30 and is fitted into a sleeve 48 which is capable of turning on the shaft 46. The sleeve 48 has one end which is located farther from the base 30 and is provided with a flange 50.

A rotary rod 52 is fitted over the end 444 of the U-shaped rod 44 such that the rotary rod 52 is prevented from slipping out of the U-shaped rod 44 by a nut 54 which is engaged with a threaded end of the end 444. A washer 56 fitted over the rotary rod 52 such that the washer 56 is located between the base 30 and the rotary rod 52.

A torsion spring 58 is located by a locating member 60 such that the torsion spring 58 is fastened with the front end of the back side of the base 30 by a fastening bolt which is engaged with the threaded hole 38. The torsion spring 58 has one end which is retained at a predetermined position on the base 30, and other end which urges the end 444 of the U-shaped rod 40 so as to keep the end 444 of the U-shaped rod 40 to locate at a position over the arcuate hole 34 and contiguous to the shaft 46.

An outer cover 62 is used to shield the back side of the base 30 in conjunction with two fastening screws.

Figure 5:
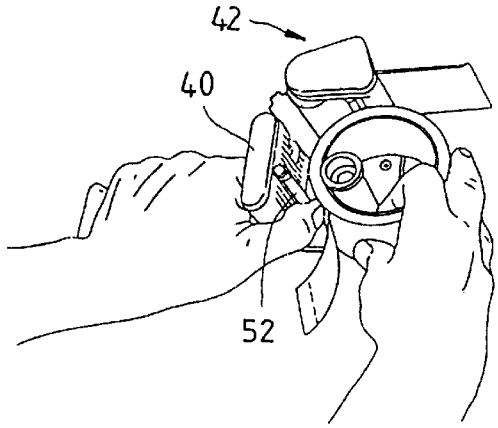
FIGS. 5–7 are schematic views of the preferred embodiment of the present invention at work.
Figure 6:
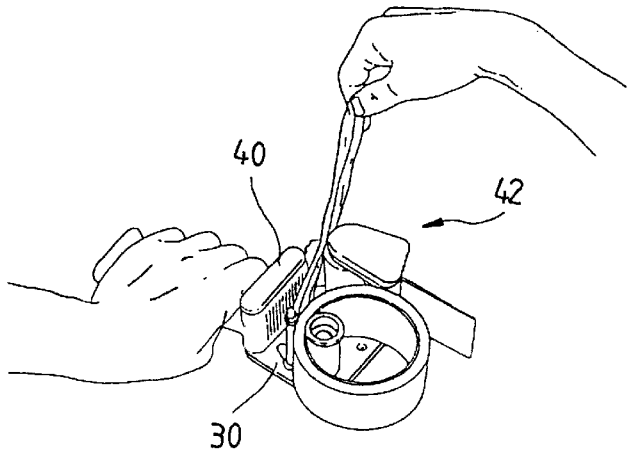
Figure 7:
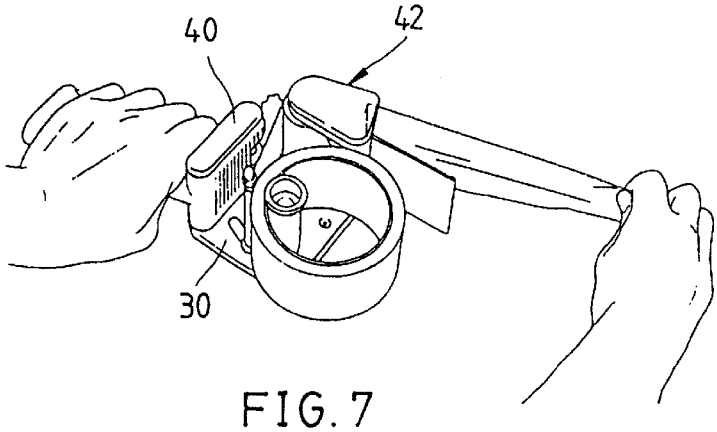

As illustrated in FIGS. 5–7, the operation of the tape dispenser of the present invention involves the first step in which the rotary rod 52 is first moved downward along the arcuate hole 34 in such a manner that the torsion spring 58 is compressed by the rotary rod 52. Thereafter, the dispenser is loaded with a tape roll before the rotary rod 52 is let go so as to release the compressed torsion spring 58, thereby causing the tape roll to be held securely between the rotary rod 52 and the sleeve 48 such that the tape roll spool is secured by the flange 50. The free end of the tape is pulled out to put through the cutting device 42 via. the rotary rod 52.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A tape dispenser comprising:

a handle;

a base fastened with said handle and provided with an arcuate hole forming an arc of an imaginary circle;

a cutting device fastened with said base for serving a tape;

a shaft fastened at one end thereof with said base such that said shaft is contiguous to one end of said arcuate hole;

a rotary rod movably received in said arcuate hole such that said rotary rod displaces along said arcuate hole to press against said shaft so as to enable a tape roll to be held securely between said shaft and said rotary rod; and an elastic member fastened at one end thereof with said base such that said rotary rod is urged by other end of said elastic member, thereby forcing said rotary rod to be retained in said arcuate hole and in the proximity of one end of said shaft whereby said elastic member is provided with a recovery force for forcing said rotary rod to return to an original position thereof after said rotary rod has displaced, wherein said base is provided with an axial hole located at the center of said imaginary circle, and a U-shaped rod having one end which is received in said axial hole, said U-shaped rod further having other end which is received in said arcuate hole; and wherein said rotary rod is fitted over said U-shaped rod.

2. The tape dispenser as defined in claim 1, wherein said elastic member is a torsion spring which is fastened pivotally at one end thereof with said base such that other end of said torsion spring urges one end of said U-shaped rod so as to force said rotary rod to remain in said arcuate hole and to remain in the proximity of one end of said shaft.

3. The tape dispenser as defined in claim 1, wherein said shaft is provided with a sleeve fitted rotatably thereover.

* * * * *